US007301316B1

(12) United States Patent
Pham

(10) Patent No.: US 7,301,316 B1
(45) Date of Patent: Nov. 27, 2007

(54) STABLE DC CURRENT SOURCE WITH COMMON-SOURCE OUTPUT STAGE

(75) Inventor: Hiep The Pham, Campbell, CA (US)

(73) Assignee: Altera Corporation, San Jose, CA (US)

( * ) Notice: Subject to any disclaimer, the term of this patent is extended or adjusted under 35 U.S.C. 154(b) by 138 days.

(21) Appl. No.: 11/203,258

(22) Filed: Aug. 12, 2005

(51) Int. Cl.
*G05F 1/56* (2006.01)

(52) U.S. Cl. ..... 323/281; 323/313; 323/315

(58) Field of Classification Search ..... 323/273, 323/280, 281, 312, 313, 315, 316
See application file for complete search history.

(56) References Cited

U.S. PATENT DOCUMENTS

| | | | | |
|---|---|---|---|---|
| 4,551,638 | A | 11/1985 | Varadarajan | |
| 5,274,323 | A * | 12/1993 | Dobkin et al. | 323/280 |
| 5,646,518 | A | 7/1997 | Lakshmikumar et al. | |
| 5,939,949 | A | 8/1999 | Olgaard et al. | |
| 6,028,640 | A * | 2/2000 | Nayebi et al. | 348/525 |
| 6,087,820 | A * | 7/2000 | Houghton et al. | 323/315 |
| 6,222,353 | B1 * | 4/2001 | Pattamatta et al. | 323/269 |
| 6,313,615 | B1 * | 11/2001 | Fayneh et al. | 323/281 |
| 6,445,167 | B1 * | 9/2002 | Marty | 323/280 |
| 6,462,584 | B1 | 10/2002 | Proebsting | |
| 6,541,949 | B2 * | 4/2003 | Sirito-Olivier | 323/315 |
| 6,700,360 | B2 * | 3/2004 | Biagi et al. | 323/280 |
| 6,703,815 | B2 * | 3/2004 | Biagi | 323/280 |
| 6,737,849 | B2 | 5/2004 | Eshraghi | |
| 6,737,908 | B2 | 5/2004 | Mottola et al. | |
| 6,774,666 | B1 | 8/2004 | Samad | |
| 6,924,693 | B1 | 8/2005 | Black | |
| 6,924,696 | B2 * | 8/2005 | Wentink | 330/69 |
| 6,940,338 | B2 * | 9/2005 | Kizaki et al. | 327/543 |
| 7,075,281 | B1 * | 7/2006 | Pettersen | 323/312 |

* cited by examiner

*Primary Examiner*—Jeffrey Sterrett
(74) *Attorney, Agent, or Firm*—G. Victor Treyz

(57) ABSTRACT

A current source is provided for use with integrated circuits such as programmable logic device integrated circuits. The current source has an operational amplifier with positive and negative inputs and an output. The output is connected to a common-source output stage. A current mirror circuit is connected between the common-source output stage and a positive power supply. An external circuit-board-mounted resistor and capacitor are connected in parallel between the common-source output stage and ground. The negative input of the operational amplifier receives a bandgap reference voltage. A feedback path is used to feed back a feedback signal from the output stage to the positive input of the operational amplifier. The feedback arrangement ensures that the bandgap reference voltage is applied across the external resistor, which, through operation of the common-source output stage and the current mirror circuit, establishes the magnitude of the current source output.

12 Claims, 5 Drawing Sheets

STABLE DC CURRENT SOURCE WITH COMMON-SOURCE OUTPUT STAGE

BACKGROUND

This invention relates to integrated circuit current sources, and more particularly, to stable low-noise integrated circuit reference current circuits.

Alternating current (AC) and direct current (DC) current sources are used in a variety of integrated circuit applications. AC current sources have output currents that are controlled as a function of time. DC current sources have a fixed current and are therefore sometimes referred to as current references.

Stability and noise immunity are important characteristics for accurate DC current sources. Even though DC current sources operate at DC (O Hz), noise and the potential for unwanted signal oscillations are generally always present. If the circuit is unstable and prone to AC noise, DC performance will be adversely affected. DC current sources should also be relatively immune to changes in their system environment, so as not to place undesirable constraints on system designers.

SUMMARY

The present invention provides a stable low-noise DC current source. The current source is formed using an integrated circuit device mounted on a circuit board. The integrated circuit device contains a reference voltage source such as a bandgap reference circuit. The bandgap reference circuit supplies a bandgap reference voltage.

An operational amplifier on the device has positive and negative inputs and an output. The output of the operational amplifier is connected to a common-source output stage. The common-source output stage may be formed from a p-channel metal-oxide-semiconductor transistor having a gate, a source, and a drain. The gate is connected to the output of the operational amplifier. A feedback path connected between the drain and the positive input feeds back a feedback signal to the input of the operational amplifier. The feedback signal maintains the voltage on the drain of the common-source output stage at the same level as the bandgap reference voltage supplied to the negative input to the operational amplifier.

A resistor and capacitor are mounted on the circuit board in parallel between the drain of the p-channel transistor and ground or other suitable power supply voltage. Because the voltage of the drain is maintained at the bandgap reference voltage through the feedback arrangement, the voltage on the drain establishes a known current through the resistor. According to Ohm's law, the current through the resistor is equal to the bandgap reference voltage divided by the magnitude of the resistance of the resistor. This current flows through the main branch of a current mirror. The current mirror has at least one other branch whose current magnitude is tied to the magnitude of the current through the main branch. The current flowing through this additional branch serves as the reference current output for the current source.

The capacitor that is connected in parallel with the resistor serves as a low-pass filter that helps to stabilize the voltage on the drain of the p-channel transistor and therefore the reference current.

Further features of the invention, its nature and various advantages will be more apparent from the accompanying drawings and the following detailed description of the preferred embodiments.

DETAILED DESCRIPTION

The present invention relates to current sources for integrated circuits. The current source circuitry of the present invention may be incorporated into any suitable integrated circuit, such as an application-specific-integrated circuit, a digital signal processing circuit, a microprocessor, a programmable logic device integrated circuit, or any other suitable analog or digital circuit.

A current source in accordance with the present invention provides a stable DC output current. DC current sources are sometimes referred to as current references or reference sources, because the output current is stable enough to be considered a reference value. The output current from a DC current source can be used in any desired application. For example, the output current from a DC current source on a programmable logic device might be used as a source of current that establishes the drive strength of an output driver (as an example).

In general, current references should exhibit low noise by being relatively immune to high-frequency (AC) effects. Current references should also be stable and not prone to undesirable oscillations. Because integrated circuits in which the current references are implemented may be installed in a wide variety of systems, it is also desirable to make current references relatively immune to environmental effects. For example, it is desirable to make current references robust enough that they are not adversely affected by varying levels of parasitic board capacitance. Current references that operate consistently regardless of the system environments in which they are installed by a system designer simplify the design process and reduce the potential for errors.

Current references in accordance with the present invention have low noise, are stable, and are relatively immune to changes in system environment.

Figure 1:
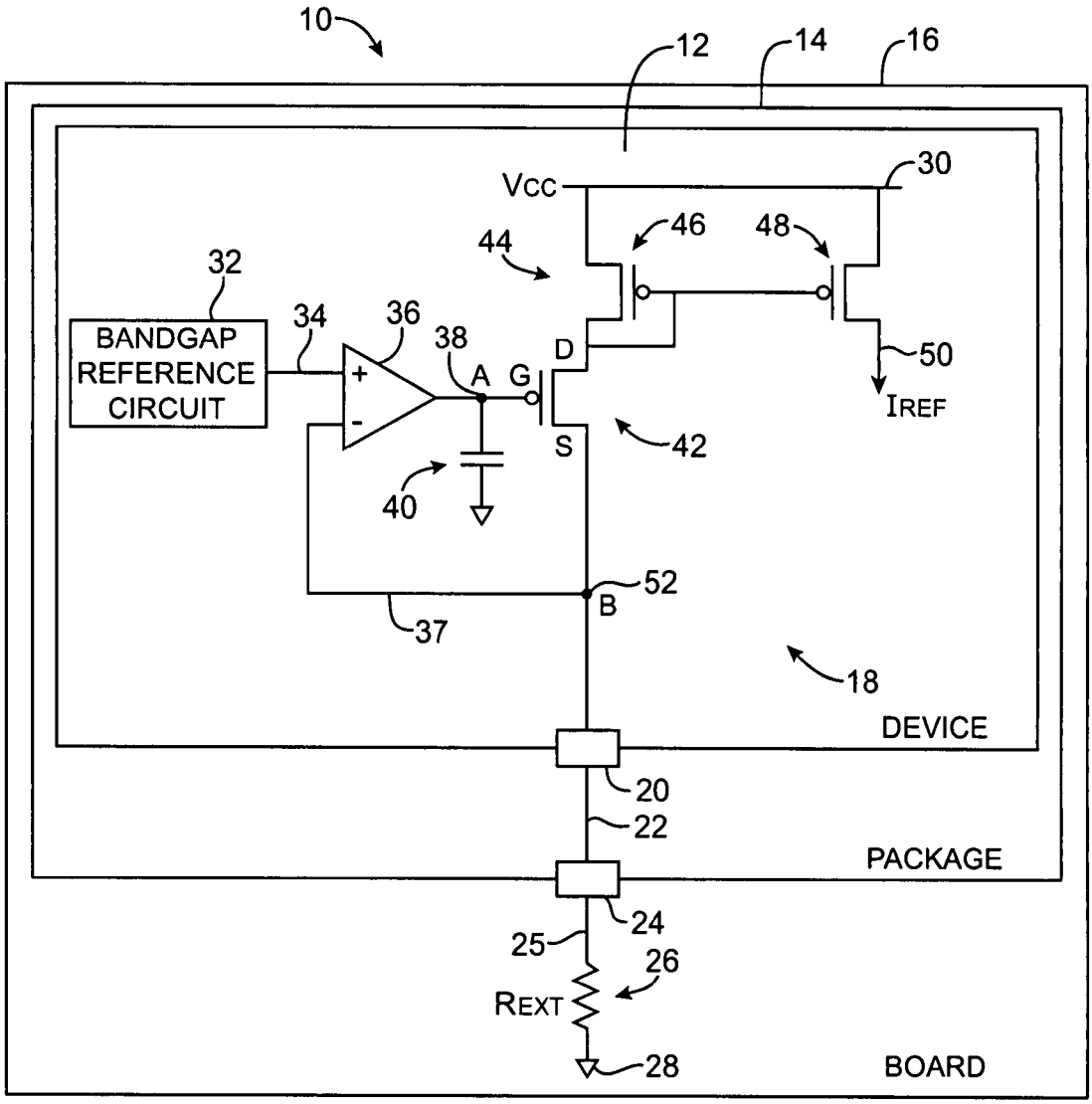
(PRIOR ART) FIG. 1
FIG. 1 is a diagram of a conventional current source.

A circuit diagram of a conventional DC current source is shown in FIG. 1. The current source 10 of FIG. 1 has three parts—integrated circuit device 12, package 14, and board 16. Current source circuitry 18 is formed as part of the integrated circuit device 12. Pads such as pad 20 on device 12 are used to electrically connect device 12 to its package 14. Package 14 has conductive paths such as conductive path 22 and pins such as pin 24 that are used to electrically connect package 14 to board 16. Board 16 is a circuit board on which numerous conductive paths such as path 25 and board-level components such as resistor 26 are connected. In the arrangement shown in FIG. 1, resistor 26 is connected between package pin 24 and a terminal 28 that is connected to a source of ground potential (e.g., 0 volts). Components such as resistor 26 are often referred to as external components, because they are not part of integrated circuit 12 and package 14.

Current source circuitry 18 has a bandgap reference circuit 32 that provides a stable bandgap reference voltage on path 34. Path 34 is connected to the positive input of operational amplifier 36. The negative terminal of operational amplifier 36 receives a feedback signal on feedback line 37.

The output of operational amplifier 36 is connected to node 38 (referred to herein as node A). An internal capacitor 40 connects node A to ground. Node A is connected to the gate terminal of n-channel metal-oxide-semiconductor (NMOS) transistor 42. The gate, source, and drain of transistor 42 are labeled "G", "S", and "D", respectively. As shown in FIG. 1, the drain of transistor 42 is connected to a current mirror 44 formed of p-channel metal-oxide-semiconductor (PMOS) transistors 46 and 48. The current mirror transistors 46 and 48 are coupled between a source of positive power supply voltage 30 (labeled Vcc) and the drain of transistor 42. The current mirror transistor 48 supplies a reference current $I_{REF}$ at current source output line 50.

Transistor 42 is connected to circuitry 18 in a "source-follower" configuration. In this arrangement, the voltage at the source of transistor 42 follows the gate voltage of transistor 42 (i.e., $V_S$ is approximately equal to $V_g$-$V_t$, where $V_t$ is the threshold voltage for transistor 42).

The voltage on the gate of transistor 42 serves to regulate the behavior of transistor 42. The voltage at node 52 (labeled node B in FIG. 1) is fed back to the negative terminal of operational amplifier 36 via feedback path 37. As a result of this feedback arrangement, any discrepancy between the voltage at node B and the reference voltage on path 34 serves as an error signal. The error signal directs amplifier 36 to either increase or decrease the voltage on node A. This voltage adjustment, in turn, serves to increase or decrease the bias voltage on the gate of transistor 42.

The effect of this feedback arrangement is to maintain the voltage of node B at the same voltage as the output of bandgap reference circuit 32. Consider, for example, the situation in which the voltage at node B falls slightly below the reference voltage on line 34. In this situation, the operational amplifier 36 senses that the voltage on its positive input terminal is higher than the voltage on its negative input terminal. In response, the operational amplifier raises its output voltage, which increases the gate voltage of transistor 42. The increased gate voltage on transistor 42 decreases the drain-source resistance of transistor 42 and lowers the drain-source voltage drop across transistor 42. As a result, the voltage on node B rises. This continues until the voltages at node B and line 34 are equal.

Similarly, if the voltage at node B is slightly above the bandgap reference voltage on line 34, the operational amplifier 36 will lower its output voltage. This lowers the gate voltage of transistor 42 and increases the drain-source resistance of transistor 42. The increased drain-source resistance of transistor 42 increases the drain-source voltage drop across transistor 42 and lowers the voltage on node B until it matches the bandgap reference voltage.

The operational amplifier 36 serves to buffer the output of the bandgap reference circuit 32 from the effects of the downstream circuitry. If operational amplifier 36 were not used, downstream circuit changes could cause the bandgap reference voltage on line 34 to sag. With the configuration of FIG. 1, however, the current flowing through line 34 to the positive input terminal of operational amplifier 36 is negligible, which isolates bandgap reference circuit 32 from the rest of the current source circuitry 18.

The operation of circuitry 18 ensures that the voltage at node B remains fixed at the bandgap reference voltage (VBG). This voltage is passed to resistor 26 via pad 20 and pin 24 and lines 22 and 25. The voltage at ground terminal 28 is typically 0 volts, so the current passing through external resistor 26 is equal to VBG divided by $R_{ext}$, according to Ohm's law. The drain-source current of transistor 46 is the same as the current flowing through resistor 26. The resistance value of the external resistor 26 therefore sets the drain-source current of transistor 46 to VBG/$R_{ext}$ and, through the operation of the current mirror 44, sets the current source output current at line 50 ($I_{REF}$).

Figure 2:
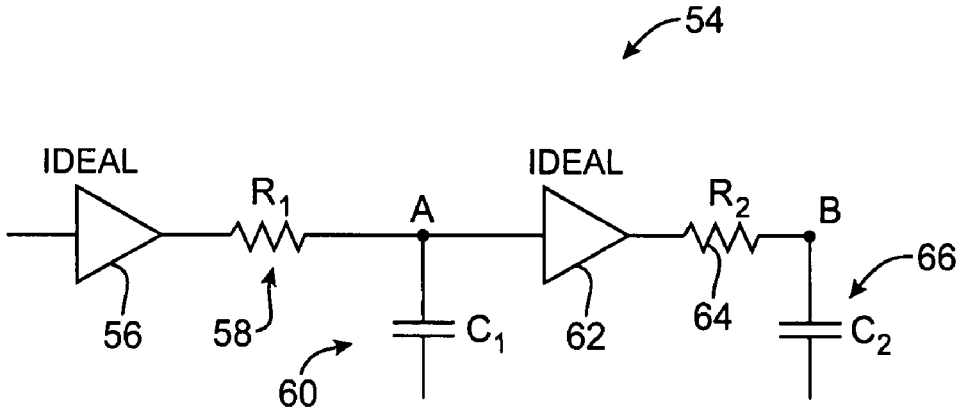
FIG. 2 is a circuit diagram showing a simplified circuit that may be used to model conventional current sources of the type shown in FIG. 1 and current sources in accordance with the present invention.

The performance of the conventional current source circuit of FIG. 1 may be understood with reference to the circuit model shown in FIG. 2. The circuit model 54 of FIG. 2 is highly simplified, but is helpful in understanding the performance of circuitry 18.

Operational amplifier 36 of FIG. 1 is modeled using ideal amplifier 56 and the low-pass filter made up of resistor 58 and capacitor 60. The source follower amplifier of FIG. 1 (transistor 42) is modeled using ideal amplifier 62 and the low-pass filter made up of resistor 64 and capacitor 66. The input to circuit 54 is on the left-hand side of FIG. 2. The output is on the right.

The values of the components in the model of FIG. 2 are related to the current source circuitry of FIG. 1. In particular, the value of $R_1$ in the circuit model represents the impedance of operational amplifier 36. The capacitance $C_1$ represents the magnitude of capacitor 40. The output impedance of transistor 42 is $R_2$. The parasitic capacitance associated with node B is $C_2$. This parasitic capacitance includes the capacitances associated with pad 20, package trace 22, package pin 24, board trace 25 and attached external components such as resistor 26. Because of the presence of many components external to device 10, the parasitic capacitance $C_2$ is strongly influenced by the decisions made by the system designer.

The DC current source circuitry of FIG. 1 is operated at DC. No high-frequency AC signals are intentionally introduced into the current source. However, modeling the AC behavior of the DC current source is helpful, because noise effects occur at AC frequencies. A DC circuit that has a high AC gain and which is unstable will tend to be noisy.

Figure 3:
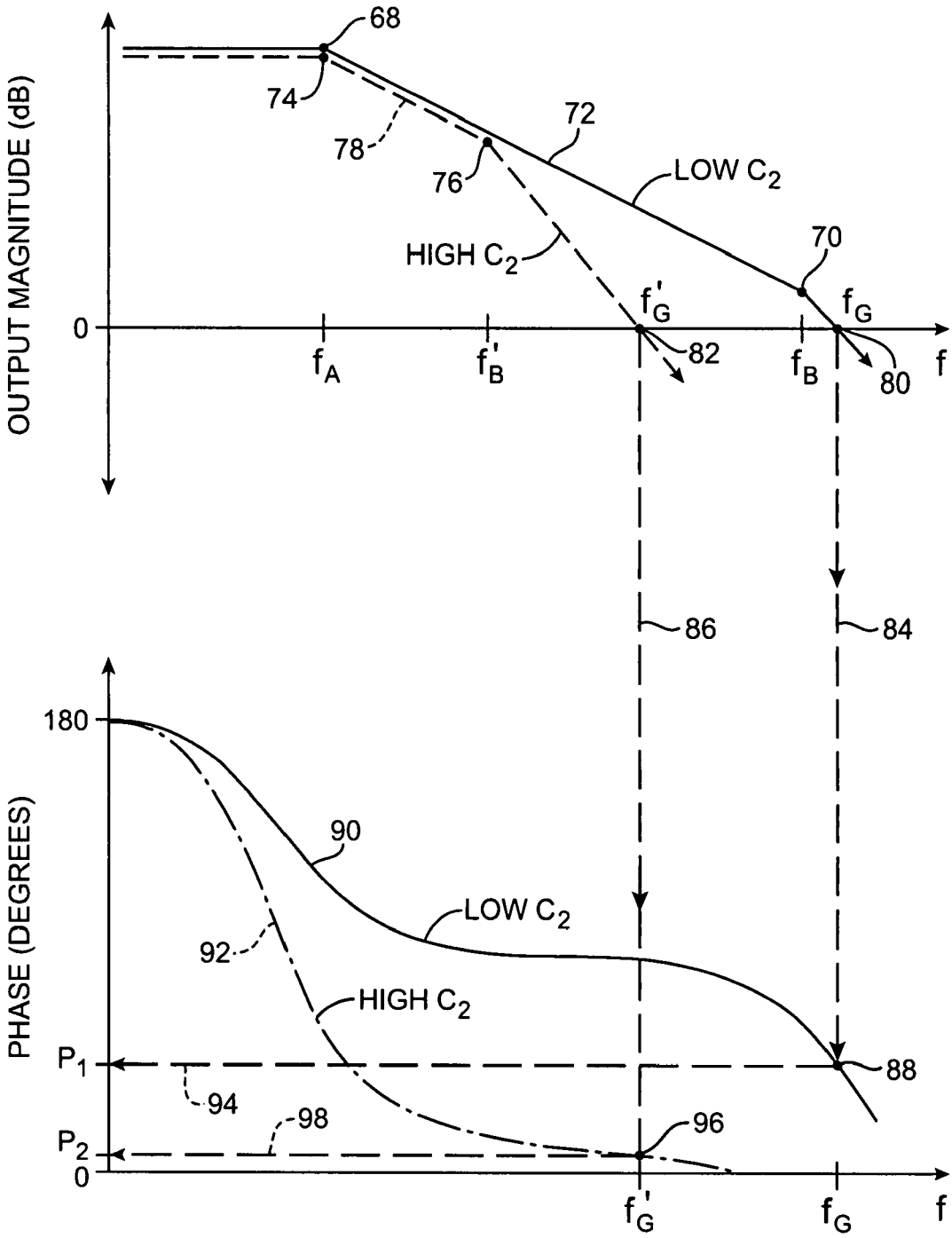
(PRIOR ART) FIG. 3
FIG. 3 shows Bode plots corresponding to a conventional circuit of the type shown in FIG. 1, when modeled using a simplified circuit of the type shown in FIG. 2.

The low-pass filters of FIG. 2 create AC resonances in the circuit. These resonances appear as "poles" when a Bode plot mathematical circuit analysis is performed. Magnitude and phase Bode plots showing the AC response of circuit 54 as a function of frequency f are shown in FIG. 3. In the upper graph of FIG. 3, output signal magnitude is plotted as a function of frequency. Output signal phase is plotted as a function of frequency in the lower graph. The lower-frequency pole in the Bode plots is referred to as the dominant pole. The higher-frequency pole in the Bode plots is referred to as the secondary pole.

The positions of the dominant and secondary poles have important implications for the behavior of the circuit 54. For example, when the poles are closely spaced, the circuit tends to be less stable, because frequencies in the vicinity of the poles are near resonances. Spacing the poles far apart in frequency tends to improve stability. Circuit performance can also be gauged using phase margin calculations, which provide insight into damping effects and circuit stability.

The Bode plots of FIG. 3 capture two scenarios. In the first scenario, represented by the solid lines in the upper and lower plots, the system designer has created a system environment in which the parasitic capacitance $C_2$ is low (e.g., 1 pF). In the second scenario, represented by the dotted lines in the upper and lower plots, the system designer has created a system environment in which the parasitic capacitance is high (e.g., 0.1 μF).

The position of the poles in FIG. 3 are inversely related to the RC products associated with the low-pass filter. The position of the dominant pole, $f_A$, is inversely proportional to the product $R_1C_1$. For a given design implementation of circuit 18, this value is fixed. There are practical limits to both $R_1$ and $C_1$ (e.g., due to real estate limitations and device considerations), but both are generally made large, to ensure that the dominant pole at $f_A$ is located at a relatively low frequency.

The position of the secondary pole is inversely proportional to the product $R_2C_2$. In a source follower design such as that used in circuit 18 of FIG. 1, the value of $R_2$ is low and is fixed. This causes the secondary pole to be located at a relatively high frequency, so long as the capacitance $C_2$ is not too high.

The value of the parasitic capacitance $C_2$ is influenced by the system environment in which device 18 is installed. The electrical characteristics of the system in which the device 18 is installed therefore influence the position of the secondary pole. When device 18 is installed in a system with short narrow paths and small pads, the parasitic capacitance $C_2$ is low and the secondary pole is located at a relatively high frequency $f_B$. When device 18 is installed in a system with long wide paths and large pads, the capacitance $C_2$ is high and the secondary pole shifts to a lower frequency $f_B'$.

The dominant and secondary poles cause break points in the output magnitude Bode plot. For example, as shown in the upper portion of FIG. 3, there is a break point 68 associated with the dominant pole and a break point 70 associated with the secondary pole in the low-capacitance output magnitude trace 72. Similarly, there is a break point 74 associated with the dominant pole and a break point 76 associated with the secondary pole in the high-capacitance output magnitude trace 78.

The values of $R_1$ and $C_1$ are fixed, so the location of the first break points (i.e., the frequency $f_A$ of the dominant pole) is unaffected by the change in parasitic capacitance $C_2$. However, the second break points 70 and 76 are significantly affected. When $C_2$ is low, the break point occurs at a high frequency $f_B$, as shown by break point 70. When $C_2$ is high, the break point position shifts to the lower frequency $f_B'$, as shown by break point 76.

The dominant and secondary poles also affect the phase plot. Each pole contributes a 90° phase shift in the phase plot. When the poles are spaced far apart, as in the low-parasitic capacitance scenario, the phase plot is characterized by a trace 90 that has two well-separated 90° phase shifts. When the poles are spaced close together, as in the high-capacitance scenario, the phase plot is characterized by a trace 92 that has a single 180° phase shift.

The different shapes of the Bode phase plots that result as the secondary pole shifts position have a significant influence on the phase margin of the circuit. To determine the phase margin, the zero intercepts of magnitude traces 72 and 78 are located. These intercepts represent the unit-gain frequencies for the low-capacitance and high-capacitance scenarios, respectively. In the present example, the unit-gain frequency associated with low-$C_2$ trace 72 is $f_G$, as indicated by point 80 in FIG. 3. The unit-gain frequency associated with high-$C_2$ trace 78 is $f_G'$, as indicated by point 82.

The phases at the unit gain frequencies $f_G$ and $f_G'$ represent the phase margins for the low-parasitic-capacitance and high-parasitic-capacitance scenarios, respectively. As shown by line 84, phase trace interception point 88, and line 94, the phase margin associated with the conventional low-$C_2$ scenario is $P_1$. Line 86, phase trace interception point 96, and line 98 show that the phase margin associated with the conventional high-$C_2$ scenario is $P_2$.

As FIG. 3 demonstrates, the phase margin and therefore the damping and stability performance of the conventional current source of FIG. 1 can be strongly influenced by the system environment in which device 18 is installed. The dependence of the performance of the current source on its environment is generally undesirable, because this complicates the design process and introduces an opportunity for error. Moreover, the smaller phase margin $P_1$ and reduced frequency spacing between the dominant and secondary poles that is associated with the high $C_2$ scenario are indicative of lower circuit performance compared to the higher phase margin $P_2$ and wider pole spacing associated with the low $C_2$ scenario. If conventional circuitry of the type shown in FIG. 1 is used in a highly capacitive system environment, performance will suffer.

Figure 4:
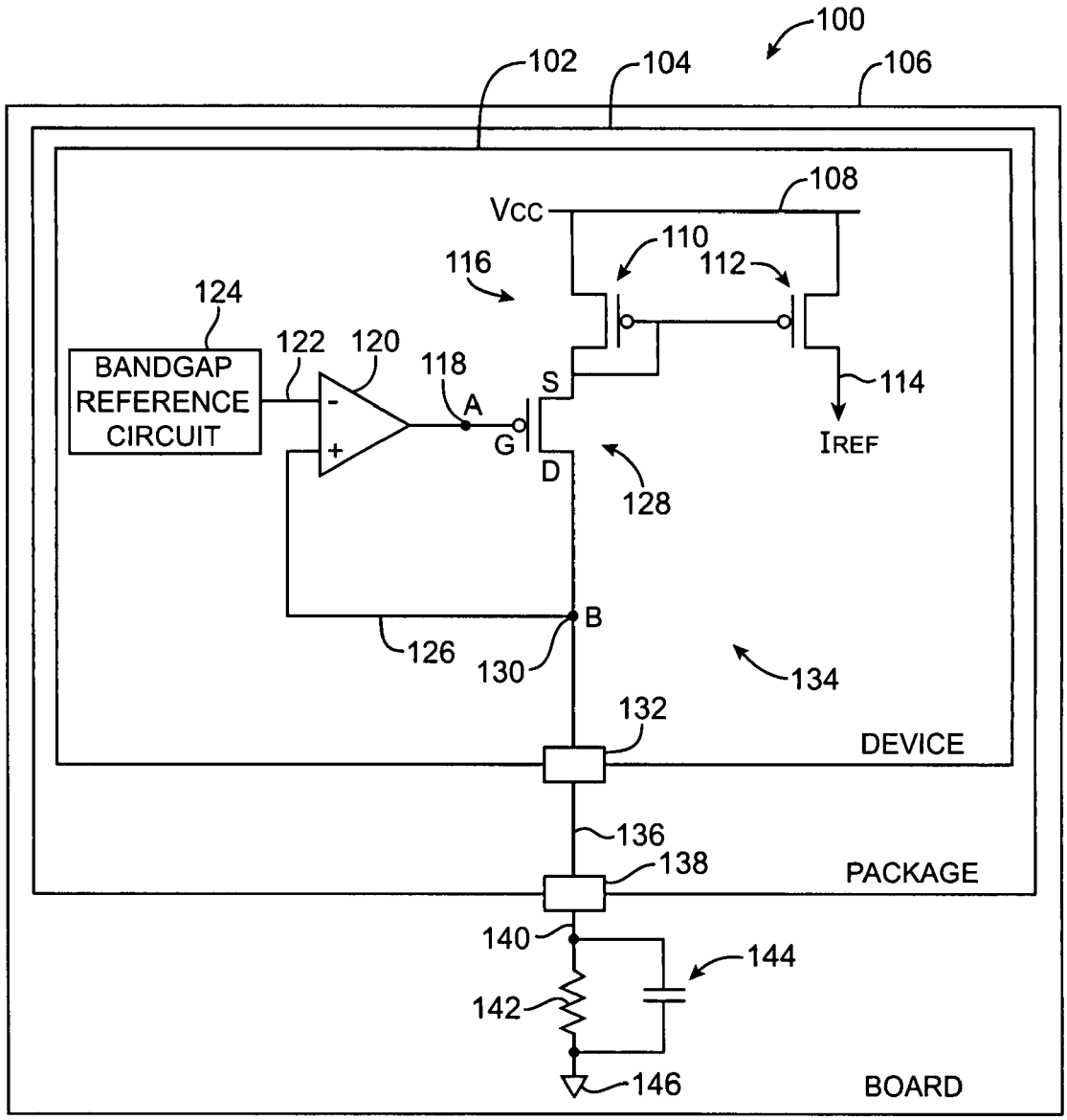
FIG. 4 is a diagram of an illustrative current source in accordance with the present invention.

The present invention provides an improved DC current source architecture. An illustrative current source 100 using DC current source circuitry in accordance with the invention is shown in FIG. 4. The current source 100 of FIG. 4 includes an integrated circuit device 102, a package 104, and a board 106. Current source circuitry 134 is formed as part of the integrated circuit device 102. Integrated circuit device 102 may be a programmable logic device integrated circuit, a digital signal processor, an application-specific integrated circuit, a microprocessor, or any other suitable integrated circuit.

Pads such as pad 132 on device 102 are used to electrically connect device 102 to its package 104. Pads 132 may be wire bonding pads, solder ball pads, or any other suitable input-output electrical contacts for connecting device 102 to package 104.

Package 104 has conductive paths such as conductive path 136 and pins such as pin 138 that are used to electrically connect package 104 to board 106. Pins 138 may be dual-inline package leads, pins in pin grid array packages, or any other suitable connecting structures. In the example of FIG. 4, there is a pad 132 and a pin 138 associated with packaging device 102 and circuitry 134 in a package. If desired, additional, intermediate-level package structures may be used to package device 102, in which case there may be more than two associated structures involved in mounting device 102 to a board. Moreover, in a typical device 102 and package 104, there are numerous pads 132 and numerous pins 138. The arrangement of FIG. 4 is merely illustrative.

As shown in FIG. 4, package pin 138 is electrically connected to board 106. Board 106 is preferably a circuit board with numerous conductive paths such as path 140. Numerous board-level components such as resistor 142 and capacitor 144 are mounted on board 106. Components such as resistor 142 and capacitor 144 may be provided using one or more resistors and capacitors connected together in series and/or in parallel. In the arrangement shown in FIG. 4, resistor 142 and capacitor 144 are connected in parallel between package pin 138 and ground 146 (i.e., a terminal 146 that is connected to a source of ground potential at 0 volts). Components such as resistor 142 and capacitor 144 are often referred to as external components, because they are not part of integrated circuit 102 and package 104.

Current source circuitry 134 has a bandgap reference circuit 124 that provides a stable bandgap reference voltage on path 122. Path 122 is connected to the negative input of operational amplifier 120. The positive terminal of operational amplifier 120 receives a feedback signal on feedback line 126. The polarity of the input terminals of operational amplifier 120 is the opposite of that for operational amplifier 36 of the conventional current source circuit of FIG. 1, because current source circuitry 134 of FIG. 4 has a common-source output stage made up of transistor 128, rather than a source-follower output stage. Operational amplifier 120 is preferably implemented using operational amplifier circuitry formed as an integral portion of integrated circuit 102.

As shown in FIG. 4, the output of operational amplifier 120 is connected to node 118 (referred to herein as node A). No internal capacitor is used to connect node A to ground. Node A is connected to the gate terminal of p-channel metal-oxide-semiconductor (PMOS) transistor 128. The gate, source, and drain of transistor 128 are labeled "G", "S", and "D", respectively. The source of transistor 128 is connected to the main branch of a current mirror 116 formed from p-channel metal-oxide-semiconductor (PMOS) transistors 110 and 112. The current mirror transistors 110 and 112 are coupled between a source of positive power supply voltage 108 (labeled Vcc) and the source of transistor 116. The current mirror transistor 112 supplies a reference current $I_{REF}$ at the current source output line 114 associated with a secondary branch of the current mirror.

In the example of FIG. 4, current mirror 116 has two branches—the main branch formed from transistor 110 and the secondary branch formed from transistor 112. This is merely illustrative. Current mirror 116 may have any suitable number of secondary branches, each of which may have any suitable current magnitude ratio relative to the main branch current (i.e., relative to the drain-source current of transistor 110).

Transistor 128 forms an output stage for the current source circuitry 134 and is connected to circuitry 134 in a common source configuration. In this arrangement, the output stage has a high output resistance (modeled as resistance $R_2$ in FIG. 5). The voltage at the drain of transistor 128 (node B) moves in the opposite direction from the voltage at node A. When the voltage at node A rises, transistor 128 tends to be turned off, which increases its resistance and lowers the voltage at node B.

The voltage at node B is fed back to the positive terminal of operational amplifier 120 via feedback path 126. This feedback arrangement ensures that the voltage at node B is maintained at a value equal to the bandgap reference voltage VBG produced at the output of bandgap reference circuit 124 on line 122. The difference in voltage between node B and path 122 serves as an error signal for amplifier 120. The error signal directs amplifier 120 to either increase or decrease the voltage on node A. This voltage adjustment serves to decrease or increase the bias voltage on the gate of transistor 128, which makes the node B voltage rise or fall as needed to match the reference voltage from circuit 124.

As an example, consider the situation in which the voltage at node B falls slightly below the reference voltage on line 122. In this situation, the operational amplifier 120 senses that the voltage on its positive input terminal is lower than the voltage on its negative input terminal. In response, the operational amplifier lowers its output voltage, which decreases the gate voltage of transistor 128. The decreased gate voltage on transistor 128 tends to turn transistor 128 on, which decreases the drain-source resistance of transistor 128 and lowers the drain-source voltage drop across transistor 128. As a result, the voltage on node B rises. This continues until the voltages at node B and line 122 are equal.

Similarly, if the voltage at node B is slightly above the bandgap reference voltage on line 122, the operational amplifier 120 will raise its output voltage. This raises the gate voltage of transistor 128 and increases the drain-source resistance of transistor 128. The increased drain-source resistance of transistor 128 increases the drain-source voltage drop across transistor 128 and lowers the voltage on node B until it matches the bandgap reference voltage.

The operational amplifier 120 serves to buffer the output of the bandgap reference circuit 124 from the effects of the downstream circuitry. If operational amplifier 120 were not used, downstream circuit changes could cause the bandgap reference voltage on line 122 to sag. With the configuration of FIG. 4, however, the current flowing through line 122 to the negative input terminal of operational amplifier 120 is negligible, which isolates bandgap reference circuit 124 from the rest of the current source circuitry 134.

The operation of circuitry 134 ensures that the voltage at node B remains fixed at the bandgap reference voltage (VBG). This voltage is passed to resistor 142 via pad 132, pin 138, and lines 136 and 140. The voltage at ground terminal 146 is typically 0 volts, so the current passing through external resistor 142 is equal to VBG divided by $R_{ext}$, according to Ohm's law. The drain-source current of transistor 128 is the same as the current flowing through resistor 142. The resistance value of the external resistor 142 therefore sets the drain-source current of transistor 128 to VBG/Rext and, through the operation of the current mirror 116, sets the current source output current at line 114 ($I_{REF}$).

The performance of the current source circuit of FIG. 4 may be understood with reference to the simplified circuit model 54 of FIG. 2, which was previously used to model the behavior of the conventional current source of FIG. 1. The circuit model 54 of FIG. 2 is highly simplified, but is helpful in understanding the performance of the FIG. 4 current source circuitry.

Operational amplifier 120 of FIG. 4 is modeled using ideal amplifier 56 and the low-pass filter made up of resistor 58 and capacitor 60 in FIG. 2. The common source amplifier of FIG. 4 (transistor 128) is modeled using ideal amplifier 62 and the low-pass filter made up of resistor 64 and capacitor 66. The input to circuit 54 is on the left-hand side of FIG. 2. The output is on the right.

The values of the components in the model of FIG. 2 are related to the current source circuitry of FIG. 4. In particular, the value of $R_1$ in the circuit model represents the impedance of operational amplifier 120. With the arrangement of FIG. 4, there is no purposefully added extra capacitor component comparable to capacitor 40 of FIG. 1, so the capacitance $C_1$ represents the magnitude of the parasitic capacitance associated with node A. The output impedance of transistor 128 is $R_2$. Because the output stage in circuitry 134 uses a common source configuration, the value of $R_2$ is relatively high.

When modeling the current source of FIG. 4, the capacitance $C_2$ represents the parasitic capacitance associated with the external components in FIG. 4 combined with the capacitance of capacitor 144. The parasitic capacitance contributions to capacitance $C_2$ include the capacitances associated with pad 132, package trace 136, package pin 138, board trace 140 and attached external components such as resistor 142. The system designer is typically instructed to include an external capacitor 144 on board 106. The capacitance of capacitor 144 represents another contribution to the magnitude of $C_2$.

The DC current source circuitry of FIG. 4 is operated at DC (0 Hz). However, as with the modeling performed in connection with the conventional current source of FIG. 1, it is helpful to model the AC behavior of the DC current source of FIG. 4, because noise effects occur at AC frequencies.

Figure 5:
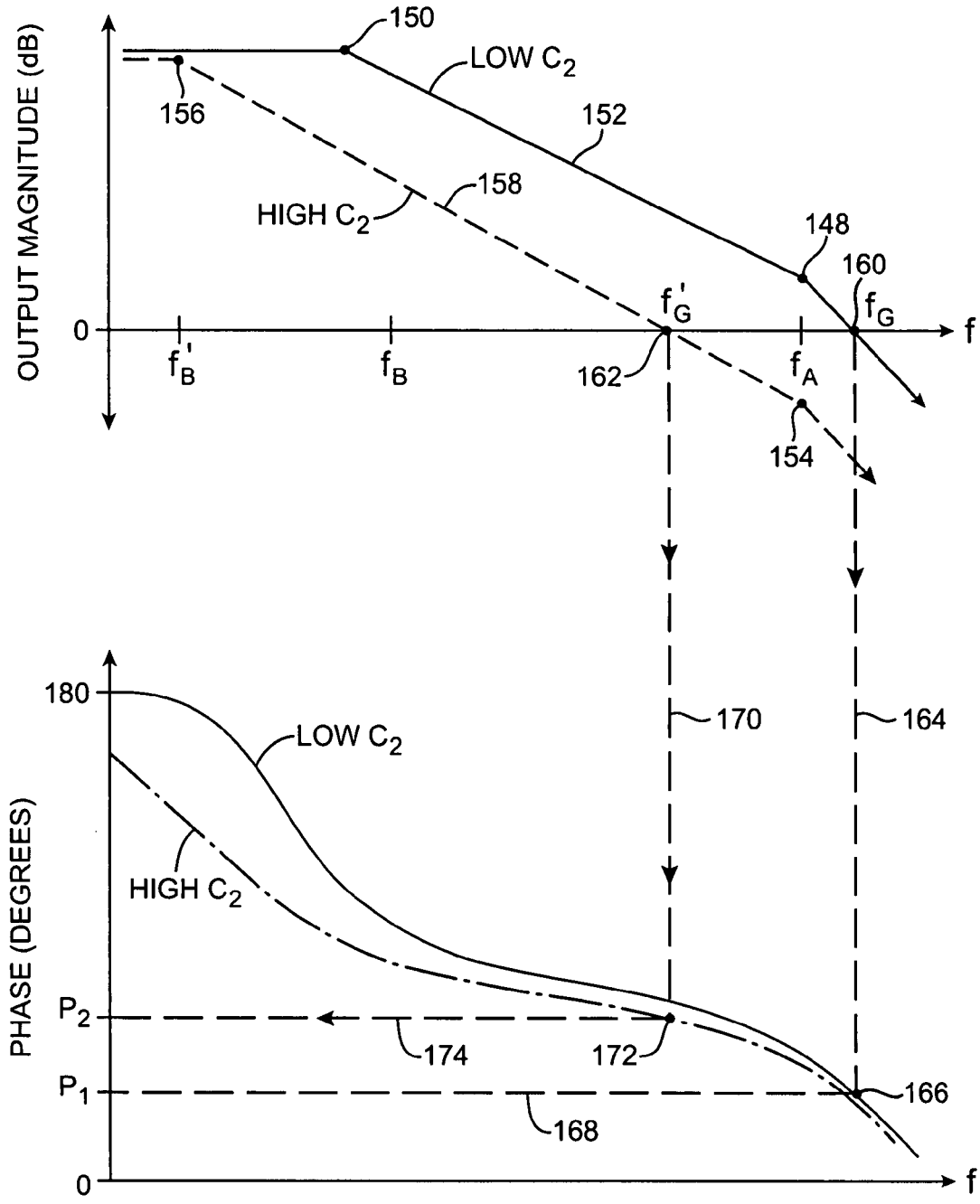
FIG. 5 shows Bode plots corresponding to the current source of FIG. 4, when modeled using a simplified circuit of the type shown in FIG. 2.

Magnitude and phase Bode plots showing the AC response of the circuit model 54 of the current source circuit of FIG. 4 as a function of frequency f are shown in FIG. 5. In the upper graph of FIG. 5, output signal magnitude is plotted as a function of frequency. Output signal phase is plotted as a function of frequency in the lower graph.

The frequency of the pole associated with operational amplifier 120 is inversely proportional to the product of $R_1$ and $C_1$. The frequency of the pole associated with output stage transistor 128 is inversely proportional to the product of $R_2$ and $C_2$. In contrast to the conventional current source of FIG. 1, the dominant pole in the circuit of FIG. 4 is associated with the output stage and the secondary pole is associated with operational amplifier 120. This is because the value of $R_2$ is high due to the use of the common source configuration for transistor 128 and because the value of $C_2$ is generally high due to the use of external capacitor 144. The product of $R_1$ and $C_1$, in contrast, is relatively low. $R_1$ is associated with the internal resistance of operational amplifier 120, which is preferably low. There is no added capacitor associated with node A, so the capacitance $C_1$ is only due to parasitics and is also low.

The Bode plots of FIG. 5 capture two scenarios. In the first scenario, represented by the solid lines in the upper and lower plots, a system designer has created a current source 100 in which the capacitance $C_2$ is low (e.g., 1 pF, due to the use of a small external capacitor 144 or the omission of capacitor 144). In the second scenario, represented by the dotted lines in the upper and lower plots, the system designer has created a current source 10 in which the capacitance $C_2$ is high (e.g., 0.1 μF due to the use of an approximately 0.1 μF external capacitor 144).

The position of the secondary pole, $f_A$, which is inversely proportional to the product $R_1C_1$, is fixed for a given design implementation of circuit 134. As a result, the plots of FIG. 5 show only a single value of $f_A$. There are practical limits to both $R_1$ and $C_1$ (e.g., due to real estate limitations and device considerations), but both are generally made relatively small, to ensure that the secondary pole at $f_A$ is located at a relatively high frequency.

The position of the dominant pole, which is inversely proportional to the product $R_2C_2$, is affected by the value of $C_2$. In a common source design such as that used in circuit 134 of FIG. 4, the value of $R_2$ is high and is fixed. This causes the dominant pole to be located at a relatively low frequency, so long as the capacitance $C_2$ is not too low. The value of the capacitance $C_2$ is influenced by the system environment in which device 102 is installed (parasitics) and by the value of external capacitor 144. If a sufficiently large external capacitor 144 is used, the capacitance of capacitor 144 dominates and the influence of parasitic capacitances may be neglected.

Although $R_2$ is fixed, the position of the secondary pole is influenced by changes in $C_2$. When $C_2$ is low, the dominant pole is located at a relatively high frequency $f_B$. When $C_2$ is high, the dominant pole shifts to a lower frequency $f_B'$.

The dominant and secondary poles cause break points in the output magnitude Bode plot. For example, as shown in the upper graph of FIG. 5, there is a break point 148 associated with the secondary pole and a break point 150 associated with the dominant pole in the low-$C_2$ output magnitude trace 152. Similarly, there is a break point 154 associated with the secondary pole and a break point 156 associated with the dominant pole in the high-$C_2$ output magnitude trace 158.

The values of $R_1$ and $C_1$ are fixed, so the location of the secondary break points (i.e., the frequency $f_A$ of the secondary pole) is unaffected by the change in capacitance $C_2$. However, the dominant break points 150 and 156 are significantly affected. When $C_2$ is low, the break point occurs at a high frequency $f_B$, as shown by break point 150. When $C_2$ is high, the break point position shifts to the lower frequency $f_B'$, as shown by break point 156.

The dominant and secondary poles affect the phase plot in the lower half of FIG. 5. Each pole contributes a 90° phase shift in the phase plot, but unlike the conventional scenario of FIGS. 1 and 3, the phase curves associated with the FIG. 4 circuit always have two well-separated 90° phase shifts. This is because increasing the capacitance $C_2$ causes the dominant pole position to shift to a frequency $f_B'$ that is farther from $f_A$ than frequency $f_B$. This is in contrast to the conventional arrangement of FIGS. 1 and 3, in which increases to $C_2$ cause the poles to move closer to each other, indicating instability. The circuit of FIG. 4 is therefore not susceptible to instabilities induced by increases in $C_2$, but rather becomes more stable in the event that $C_2$ is increased. The common source configuration of transistor 128 (FIG. 4) ensures that $R_2$ will be high, so $f_B$ will be relatively low, even if $C_2$ is relatively low. If $C_2$ is made large by a system designer, the product of $R_2C_2$ will be even larger and the current source of FIG. 4 will be even more stable.

To determine the phase margin for the circuit of FIG. 4 under both low-$C_2$ and high-$C_2$ scenarios, the zero intercepts of magnitude traces 152 and 158 of FIG. 5 are located. These intercepts represent the unit-gain frequencies for the low-capacitance and high capacitance scenarios, respectively. The unit-gain frequency associated with low-$C_2$ trace 152 is $f_G$, as indicated by point 160 in FIG. 5. The unit-gain frequency associated with high-$C_2$ trace 158 is $f_G'$, as indicated by point 162.

The phases at the unit gain frequencies $f_G$ and $f_G'$ represent the phase margins for the low-$C_2$ and high-$C_2$ scenarios, respectively. As shown by line 164, phase trace interception point 166, and line 168, the phase margin associated with the conventional low-$C_2$ scenario is $P_1$. Line 170, phase trace interception point 172, and line 174 show that the phase margin $P_2$ that is associated with the conventional high-$C_2$ scenario is greater than the low-$C_2$ phase margin $P_1$.

As FIG. 5 demonstrates, the current source of FIG. 4 in accordance with the present invention has a higher phase margin and a larger dominant-to-secondary pole spacing as $C_2$ increases, indicating improved damping and stability. In contrast, the phase margin and pole-to-pole spacing in the conventional current source of FIG. 1 degrade as $C_2$ increases. The larger phase margin $P_2$ and increased frequency spacing between the dominant and secondary poles that is associated with the high $C_2$ scenario in the current source of FIG. 4 are indicative of good AC noise performance.

AC noise performance may also be improved through the use of higher gain in the output stage of the current source. In the conventional circuit of FIG. 1, the output stage source follower has a gain of about 0.5. As a result, the gain of operational amplifier 36 must be relatively high to ensure adequate overall gain. This tends to exacerbate AC noise effects in conventional current sources.

In the current source of FIG. 4, in contrast, the gain of common source amplifier 128 is about 2. This allows the overall gain between the negative terminal input to operational amplifier 120 and node B to be maintained at an acceptably high level to ensure an adequate feedback signal over path 126, while reducing the gain contribution from the operational amplifier circuit 120. Because of the potential for reducing the gain of operational amplifier 120, it may be possible to lower the resistance $R_1$ associated with amplifier 120, further ensuring that $R_1$ is small and $f_A$ is large.

Moreover, the use of large capacitances for capacitor 144 not only stabilizes the circuit by moving the dominant pole farther from the secondary pole, but also creates a low-pass filter that reduces AC noise on node 138. Because the AC noise filtering properties of capacitor 144 stabilize the DC voltage level across resistor 142, the current through resistor 142 is made more stable, which increases the stability of $I_{REF}$.

The foregoing is merely illustrative of the principles of this invention and various modifications can be made by those skilled in the art without departing from the scope and spirit of the invention.

What is claimed is:

1. Current source circuitry formed from an integrated circuit comprising:

an operational amplifier having negative and positive inputs and a corresponding operational amplifier output;

a bandgap reference circuit on the integrated circuit that applies a bandgap reference voltage to the negative input;

a common-source output stage connected to the operational amplifier output;

a feedback path between the common-source output stage and the positive input of the operational amplifier;

a node connected to the common-source output stage; and an external resistor connected between the node and ground, wherein the external resistor is separate from the integrated circuit, wherein the external resistor has a resistance, and wherein feedback through the feedback path maintains the node at the bandgap reference voltage, so that a current equal to the bandgap reference voltage divided by the resistance of the external resistor flows through the resistor.

2. The current source circuitry defined in claim 1 wherein the common-source output stage comprises a p-channel metal-oxide-semiconductor transistor having a gate, a source, and a drain, wherein the gate is connected to the output of the operational amplifier, and wherein the drain is connected to the feedback path, the current source circuitry further comprising:

a current mirror connected to the source of the p-channel metal-oxide-semiconductor transistor; and an external capacitor connected between the drain and ground.

3. The current source circuitry defined in claim 1 wherein the common-source output stage comprises a p-channel metal-oxide-semiconductor transistor having a gate, a source, and a drain, wherein the gate is connected to the output of the operational amplifier, and wherein the drain is connected to the feedback path, the current source circuitry further comprising a current mirror connected to the source of the p-channel metal-oxide-semiconductor transistor.

4. The current source circuitry defined in claim 1 wherein the common-source output stage comprises a p-channel metal-oxide-semiconductor transistor.

5. The current source circuitry defined in claim 1 wherein the common-source output stage comprises a p-channel metal-oxide-semiconductor transistor having a gate, a source, and a drain and wherein the gate is connected to the output of the operational amplifier.

6. The current source circuitry defined in claim 1 wherein the common-source output stage comprises a p-channel metal-oxide-semiconductor transistor having a gate, a source, and a drain, wherein the gate is connected to the output of the operational amplifier, and wherein the drain is connected to the feedback path.

7. The current source circuitry defined in claim 1 further comprising a current mirror connected to the common-source output stage.

8. A current source formed from an integrated circuit device mounted on a circuit board, comprising:

an operational amplifier on the device having negative and positive inputs and a corresponding operational amplifier output;

a bandgap reference circuit on the device that applies a bandgap reference voltage to the negative input;

a p-channel metal-oxide-semiconductor transistor on the device having a gate, a drain, and a source, wherein the gate is connected to the operational amplifier output;

a feedback path on the device connected between the drain and the positive input, wherein the feedback path is used in maintaining the drain of the p-channel metal-oxide-semiconductor transistor at the bandgap reference voltage;

a current mirror circuit on the device that is connected between the source and a positive power supply voltage and that has an output that supplies a reference current having a magnitude; and an external resistor that is separate from the integrated circuit, that is mounted to the circuit board, and that is connected between the drain and ground, wherein the resistor has a magnitude that sets the magnitude of the reference current and wherein a current flows through the resistor that is equal to the bandgap voltage divided by the magnitude of the resistor.

9. The current source defined in claim 8 wherein the current mirror comprises at least two current mirror transistors and wherein the bandgap reference voltage divided by the magnitude of the resistor equals the reference current.

10. The current source defined in claim 8 further comprising a capacitor mounted to the circuit board and connected between the drain and ground.

11. The current source defined in claim 8 further comprising a capacitor mounted to the circuit board and connected between the drain and ground, wherein no capacitor is connected to the operational amplifier output.

12. The current source defined in claim 8 further comprising a capacitor mounted to the circuit board and connected between the drain and ground, wherein the reference current is a DC reference current.

* * * * *